United States Patent [19]

Stevenson

[11] 4,236,622

[45] Dec. 2, 1980

[54] COIN OPERATED TIRE INFLATING APPARATUS

[76] Inventor: James G. Stevenson, 40890 Grand River, Novi, Mich. 48050

[21] Appl. No.: 19,769

[22] Filed: Mar. 12, 1979

[51] Int. Cl.[3] ..... G07F 17/06

[52] U.S. Cl. ..... 194/87; 137/224.5; 141/197; 194/DIG. 18

[58] Field of Search ..... 194/9 T, 1 R, 3, DIG. 18, 194/87; 222/3; 141/197; 152/415; 137/224.5, 224, 225, 227, 229

[56] References Cited

U.S. PATENT DOCUMENTS

| | | | |
|---|---|---|---|
| 631,802 | 8/1899 | Macy | 194/3 |
| 691,747 | 1/1902 | Champ | 141/197 |
| 700,796 | 5/1902 | Molyneux | 194/3 |
| 2,288,880 | 7/1942 | Barker | 137/224.5 |
| 2,513,701 | 7/1950 | Woodford et al. | 137/224.5 |

*Primary Examiner*—F. J. Bartuska

*Attorney, Agent, or Firm*—Charles W. Chandler

[57] ABSTRACT

Pneumatically operated, coin actuated apparatus for inflating tires for a predetermined period of time.

5 Claims, 5 Drawing Figures

COIN OPERATED TIRE INFLATING APPARATUS

BACKGROUND OF THE INVENTION

This inventon is related to means for inflating tires and other inflatable devices, and more particularly to pneumatically-operated apparatus actuated by the motion of a coin. A timing device permits the apparatus to be used for a predetermined period of time after the timing device has been actuated.

Many motorists have their tires inflated at their local gas station. Such gas stations formerly provided such air without costs. Recently, many service stations have either discontinued such service or have connected coin-operated devices to the inflation apparatus.

Conventional coin-operated devices usually employ an electrically-operated arrangement permitting operation of the inflation apparatus for a predetermined period of time. Although such electrically-operated apparatus is relatively inexpensive to operate, the location of the inflation apparatus often requires the costly installation of an electrical supply line to the timing device.

SUMMARY OF THE INVENTION

The broad purpose of the present invention is to provide pneumatically-operated, coin actuated timing means for tire inflation apparatus. In the preferred embodiment of the invention, a pneumatic operator is operated by the compressed air delivered to the inflation apparatus. Preferably the inflation apparatus supplies air to the tire in short pulses to gradually increase the tire pressure to a predetermined level.

Still further objects and advantages of the present invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
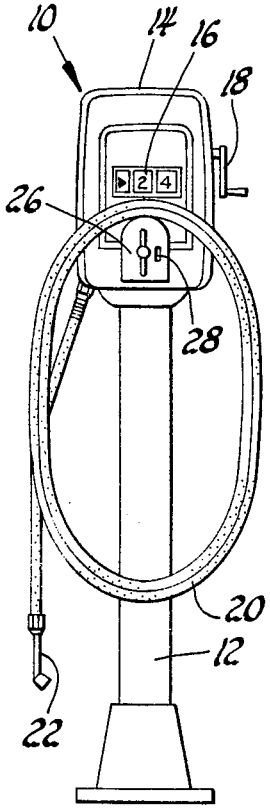
FIG. 1 is a perspective view of a coin-operated tire inflation apparatus illustrating the preferred embodiment of the invention.

Referring to the drawings, a preferred inflation apparatus is illustrated at 10, in FIG. 1, mounted on a post 12 having a housing 14. Dial means 16 is mounted in the housing and a handle 18 permits the user to select the air pressure he desires to deliver to an inflatable device. A hose 20 has a chuck valve 22, adapted to be engaged with the valve stem of a tire, connected to the hose end. A coin-operated timing means 26 is mounted on the front of the housing, and has an opening 28 for receiving a coin for actuating the control mechanism. Hose 20 is coiled on means 26.

The general principles of the type of tire inflating apparatus is disclosed in U.S. Pat. Nos. 2,126,693, 2,288,880, 2,162,474, 2,303,316, 2,307,911, 2,513,701, 2,547,741, and 2,585,362.

Figure 2:
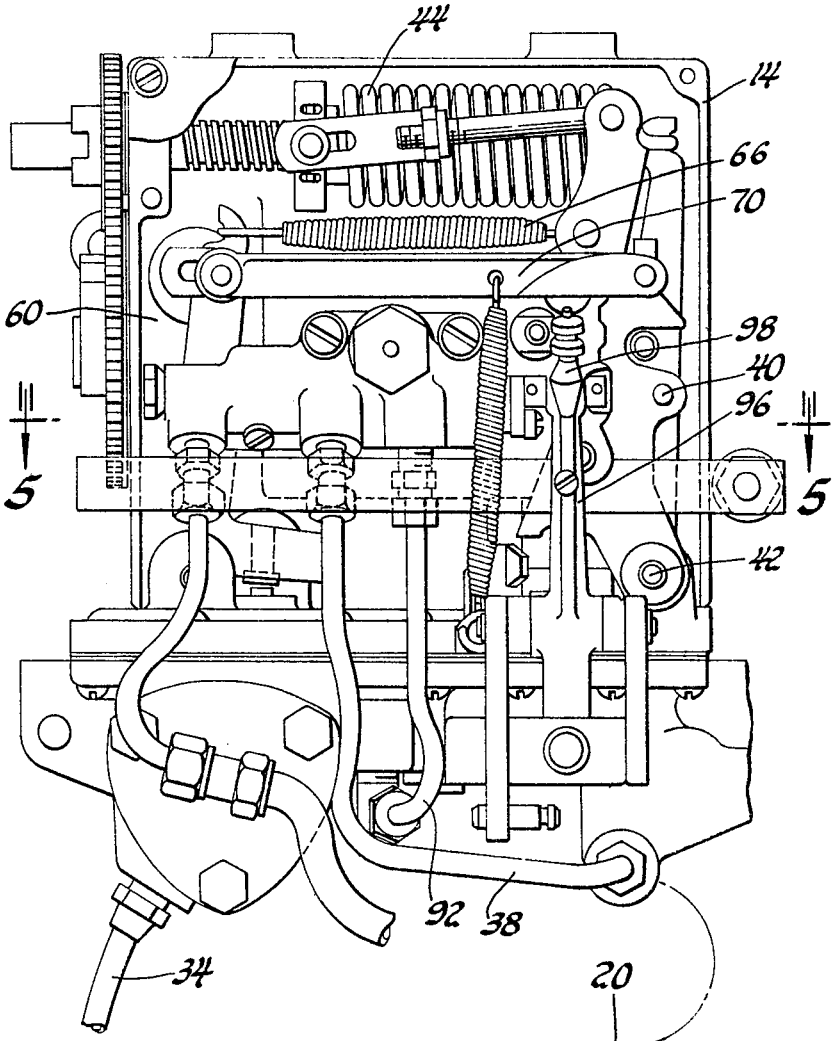
FIG. 2 is a rear fragmentary view of the preferred tire inflation apparatus.
Figure 3:
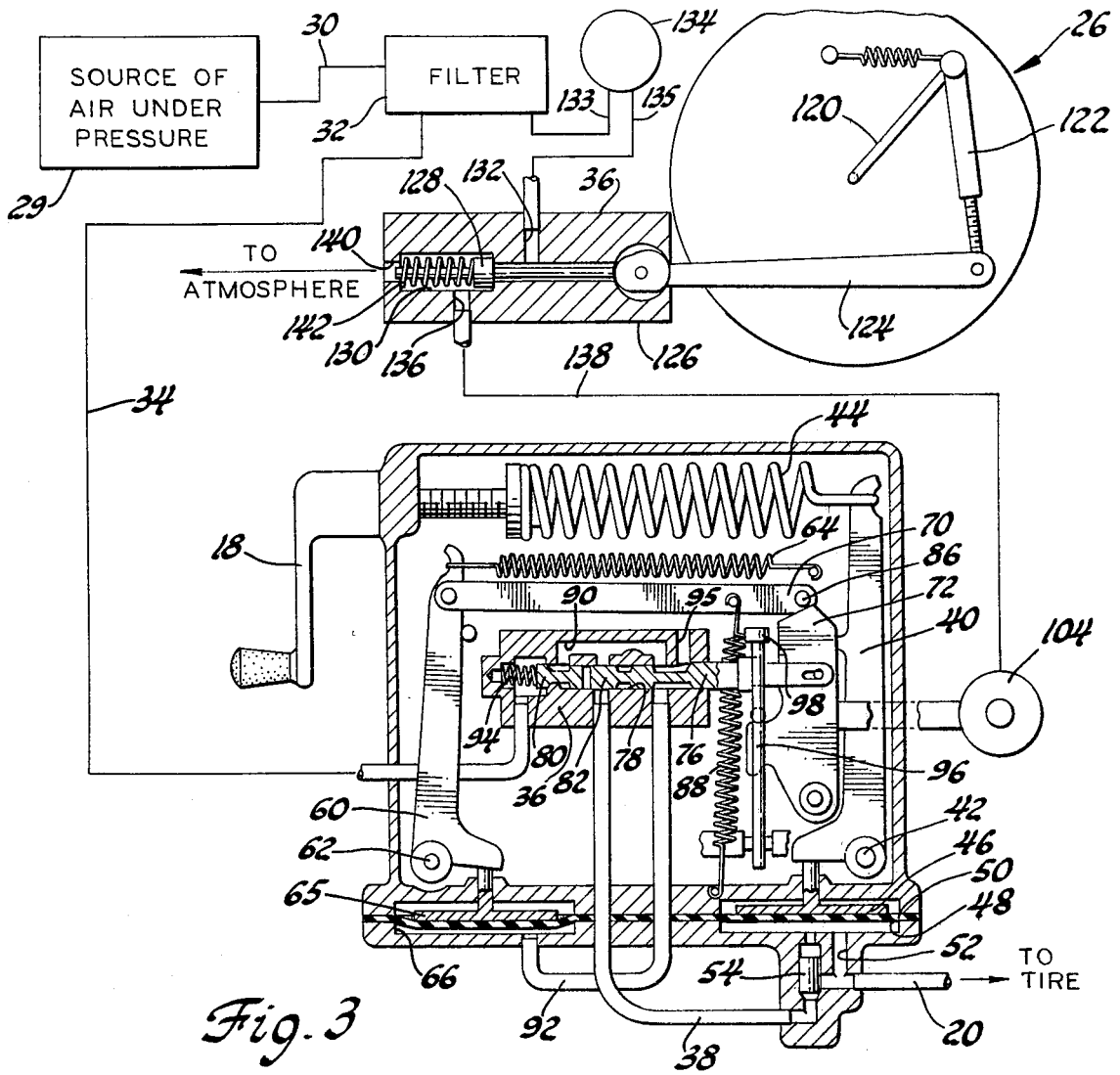
FIG. 3 is a partially schematic view of the preferred tire inflation apparatus.

FIG. 2 illustrates the back of housing 14 exposing the internal regulating apparatus. FIG. 3 is a schematic diagram of the preferred apparatus.

A source of air under pressure 29, which may be a suitably located air compressor, provides air to an input conduit 30 and a filter 32. A conduit 34 connects the output of filter 32 to valve means 36. The output of valve means 36 is through a conduit 38 which is connected to hose 20 for delivering air from source 29 to chuck valve 22.

The control mechanism includes an inflator lever 40 pivotally connected by means 42 to housing 26. A main spring 44 has one end connected to the upper end of lever 40 and its opposite end connected to handle 18 such that the bias of the spring on the lever is adjusted according to the air pressure indicated on dial means 16. An inflator diaphragm plate 46 is disposed in inflator air chamber 48 on a diaphragm member 50. The upper end of the diaphragm plate is engaged with the lower end of lever 40. The bias of spring 44 causes lever 40 to impose a downward bias on the diaphragm plate.

A short passage 52 provides communication between hose 20 and the lower part of the diaphragm chamber such that air pressure therein imposes a clockwise bias against lever 40. When the air pressure beneath diaphragm 50 is reduced, spring 44 moves lever 40 counterclockwise. On the other hand, when the air pressure beneath the diaphragm remains constant and balances the bias of spring 44, lever 40 remains stationary.

The air pressure beneath the diaphragm is maintained by a check valve 54 exposed to the pressure in conduit 38 and the pressure in the diaphragm chamber. The pressure in the diaphragm chamber beneath the diaphragm is maintained by chuck valve 22. If chuck valve 22 is opened to reduce the air pressure in the diaphragm chamber, main spring 44 pulls inflator lever 40 counterclockwise. This lever motion occurs when the air pressure beneath the diaphragm is reduced below the pressure set on dial means 16.

A motor lever 60 is mounted by pivot means to the opposite side of housing 26. A spring member 64 is connected to the upper end of lever 60 and its opposite end is connected to the housing to bias the motor lever in the clockwise direction. A second diaphragm plate 65 is mounted in diaphragm chamber 66 beneath lever 60. Lever 60 urges a downward motion on diaphragm plate 65. The air pressure beneath diaphragm plate 65 biases it upwardly against lever 60.

A roller lever 70 has one end connected to the upper end of lever 60 and its opposite end riding on the upper end of a valve cam 72 pivotally mounted adjacent lever 40.

A plunger 76 is connected to cam 72 so as to be slidably movable in a valve passage 78 as cam 72 is being pivoted. Plunger 76 includes a main valve 80 and a safety valve 82. The arrangement is such that when the cam is pivoted in a counterclockwise direction, it moves the plunger to open main valve 80 and safety valve 82. As the cam is pivoted in the clockwise direction, it is operative to close both valves.

Still referring to FIG. 3, when the inflator lever is pivoted in the counterclockwise direction because of reduced air pressure in diaphragm chamber 50, lever 40 pushes cam 72 in the counterclockwise direction. As the point on the top of the cam moves past roller 86 carried by the lever 70, a spring 88 connected between lever 70 and the housing imposes a downward bias on lever 64 to snap cam 72 to the left thereby opening the main valve and the safety valve. As these two valves open, air from source 29 passes through conduit 34 and into passage 90, through the safety valve, through conduit 38, past valve 54, and through hose 20 to the tire. This pressure opens check valve 54 so that some of the air passes through passage 52 into the bottom of chamber 48. The air pressure in chamber 48 causes diaphragm 50 to move upwardly thereby moving the inflator lever in the clockwise direction.

At the same time, air in the control valve passes from passage 90 down through a conduit 92 into diaphragm chamber 66. As the air pressure in chamber 66 increases against the bottom of the diaphragm, diaphragm plate 65 moves upwardly to move lever 60 in the counterclockwise direction against the bias of spring 64. As lever 60 moves to the left, it pulls the lever roller to the left across the top of cam 72. The downward bias of spring 88 and the bias of spring 94 then causes the roller to snap the valve to the right thereby closing the safety valve and the main valve to block the passage of air to the tire. As the air pressure in conduit 38 is reduced, check valve 54 also closes.

As the valve plunger is moved to the right, it opens a vent 95 to the atmosphere which allows air in the air chamber to escape.

At this point, if the air pressure beneath diaphragm plate 46 has reached the level registered on dial means 16, there is no further motion of lever 40. On the other hand, if the air pressure beneath diaphragm plate 46 has not reached the desired air pressure, lever 40 then pivots in the counterclockwise direction to repeat the cycle. The cycle is repeated to progressively increase the tire pressure until it reaches the desired air pressure.

Figure 5:
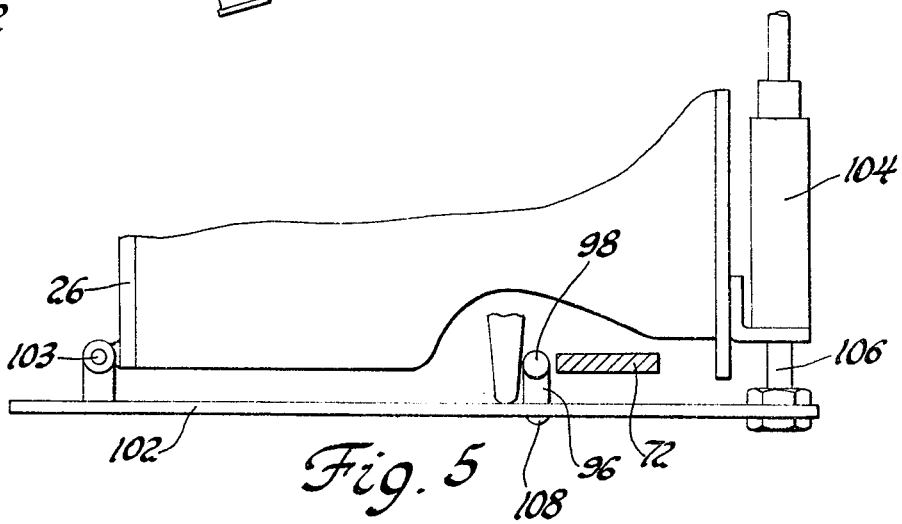
FIG. 5 is a fragmentary view taken along lines 5—5 of FIG. 2.

As illustrated in FIGS. 2 and 5, a lock-out lever 96 having its lower end pivotally connected to the housing, and its upper end supporting a roller 98, is mounted adjacent cam 72. Lever 96 is movable to a position in which roller 98 engages the cam to prevent its counterclockwise motion and thus to prevent opening of the main valve and the safety valve. In its alternate position, the upper end of lock-out lever 96 is pivoted outwardly so that the roller is not disposed in the path of motion of lever 72.

Referring to FIG. 5, a lever 102 is pivotally mounted at 103 on housing 26. A pneumatic operator 104 is mounted at the opposite end of the housing and has a spring-loaded piston rod 106 connected to the lever to pivot it with respect to pivot means 103. Fastener means 108 connects lever 102 to the lock-out lever.

Figure 4:
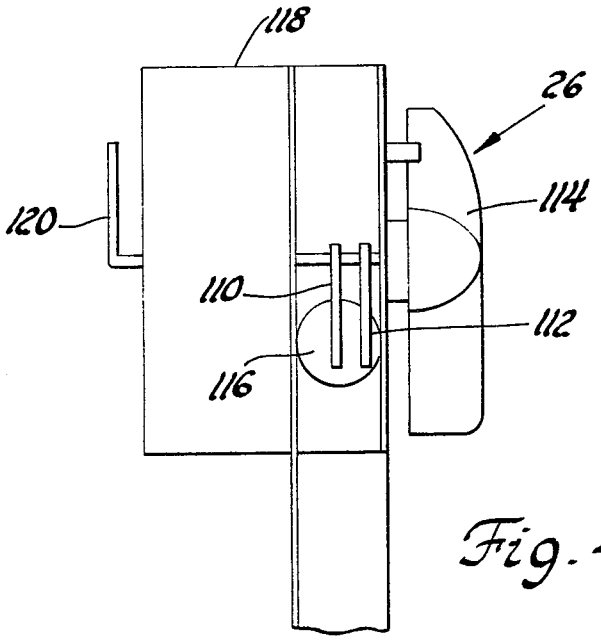
FIG. 4 is a view of the coin-operated timing means as seen from the right side of FIG. 3.

Referring to FIGS. 1, 3, and 4, coin-operated timing means 26 has internally housed levers 110 and 112. The two levers are pivotable with respect to one another. Lever 112 is movable with a handle 114. Lever 110 is connected to an internal conventional mechanical timing mechanism in housing 118. The timing mechanism is actuated by the rotation of lever 110. When a coin 116 is inserted in opening 28, it is disposed in a position in which it connects lever 110 and 112. As the user rotates handle 114, the coin forms a connection to rotate lever 110 and actuate the timing cycle. As lever 110 is rotated, a lever 120 at the rear of the housing 118, is also pivoted, as illustrated in FIG. 3. A link 122 connects lever 120 to a lever 124 carried on a pneumatic valve 126.

Valve 126 has an internally mounted plunger 128 that is movable in passage 130, and an input passage 132. The output of filter 32 is through conduit 133, through a pressure regulator 134, and through conduit 135 to passage 132. An output passage 136 is connected by conduit 138 to pneumatic operator 104. A second output passage 140 is operative to exhaust air to the atmosphere. A spring 142 normally biases plunger 128 toward the position illustrated in FIG. 3.

As lever 120 is moved in the counterclockwise direction, it causes lever 124 to open communication between passage 132 and 136 so that air under pressure is delivered to operator 104 which in turn pivots lever 96 to a position permitting the cam to be operated by the motion of lever 40. Valve plunger 128 remains open until lever 120 is returned toward its initial position by the timing means to close communication between passage 132 and 136. In this position, any residual air pressure in conduit 138 is exhausted to the atmosphere thereby permitting piston rod 106 to be retracted to move the lock-out lever to its lock-out position and prevent further motion of lever 72.

In operation, main valve 80 is disposed to block air from being delivered under pressure from source 29 to hose 20 unless a coin 116 is inserted in the coin-operated timing means. The motion of the coin in the timing mechanism triggers the timing means to permit the user to deliver air to an inflatable device, such as a tire, to the air pressure set by dial means 16. When lever 120 has been returned toward its initial position, pneumatic operator 104 is then operative to prevent any further air from being delivered to the tire until another coin is inserted into the timing means.

It is to be noted that the pneumatic operator is operated by air from the same source delivered to valve 36 so that no electrical connections are necessary.

Having described my invention, I claim:

1. In an inflating apparatus, the combination comprising:

a first conduit and means for delivering air thereto under pressure;

a second conduit for delivering air under pressure to an inflatable object;

valve means connected between the first conduit and the second conduit, said valve means being movable to a first position for passing air from the first conduit to said second conduit, from a second position in which the valve means are operative to prevent passage of such air;

a coin-operated means having an opening for receiving a coin; and a pneumatic operator connected to the valve means for preventing movement thereof from said second position to said first position, and being so connected to the coin-operated means as to be responsive to a motion of the coin with respect to said coin-operated means to pneumatically actuate the first valve means to permit said air under pressure to pass from the first conduit toward said second conduit.

2. In a device for inflating a pneumatic tire by pulsations of air under pressure, the combination comprising:

a source of air under pressure;

first valve means;

a first conduit for connecting said air to said first valve means;

a second conduit for passing air from the first valve means to an inflatable device;

a diaphragm member and means connecting the second conduit to one side of the diaphragm member, said air pressure in the second conduit being operative to move the diaphragm member in a first direction;

a lever and adjustable means biasing the same in a second direction, the lever being connected to the diaphragm member so as to oppose the motion thereof by said air pressure;

means for opening the first valve means to deliver additional air to the second conduit depending upon the position of the diaphragm member;

a lock-out member disposed in a first position to prevent motion of the first valve means to pass air to the second conduit;

a pneumatic operator connected to the lock-out member and being operative to move same to a second position permitting motion of the first valve means to pass air from the first conduit to the second conduit; and a coin and coin-operated means disposed between said source of air under pressure and the pneumatic operator, said coin-operated means being operative to open communication between the source of air and the pneumatic operator to move the lock-out member to said second position in response to the motion of said coin with respect to said coin-operated means.

3. A device as defined in claim 2, including means for automatically opening the first valve means when the pressure in the second conduit has increased, and then closing the first valve means depending upon the increased pressure in the second conduit.

4. A device as defined in claim 3, in which the first valve means is movable between open and closed positions until the air pressure in the second conduit has increased to a predetermined level.

5. A device as defined in claim 2, in which the coin-operated means is operative to close communication between the source of air under pressure and the pneumatic operator a predetermined time after said communication has been opened.

* * * * *